US009500384B2

(12) United States Patent
McFarland

(10) Patent No.: US 9,500,384 B2
(45) Date of Patent: Nov. 22, 2016

(54) ELECTRONIC EVAPORATIVE COOLER CONTROLLER WITH WIRELESS REMOTE SENSOR

(71) Applicant: Harold G McFarland, Arvada, CO (US)

(72) Inventor: Harold G McFarland, Arvada, CO (US)

( * ) Notice: Subject to any disclaimer, the term of this patent is extended or adjusted under 35 U.S.C. 154(b) by 698 days.

(21) Appl. No.: 14/055,211

(22) Filed: Oct. 16, 2013

(65) Prior Publication Data

US 2015/0102114 A1 Apr. 16, 2015

(51) Int. Cl.
*F24F 11/00* (2006.01)

(52) U.S. Cl.
CPC ..... *F24F 11/0015* (2013.01); *F24F 11/0012* (2013.01); *F24F 2011/0058* (2013.01); *F24F 2011/0068* (2013.01)

(58) Field of Classification Search
CPC ..... F24F 2011/0058; F24F 11/0015; F24F 2011/0068
See application file for complete search history.

(56) References Cited

U.S. PATENT DOCUMENTS

| | | | | |
|---|---|---|---|---|
| 4,178,764 | A | 12/1979 | Rowe | |
| 4,232,531 | A | 11/1980 | Jones et al. | |
| 4,379,712 | A | 4/1983 | Sperr, Jr. et al. | |
| 4,580,403 | A | 4/1986 | Hummel | |
| 4,673,028 | A | 6/1987 | Meland | |
| 4,734,871 | A | 3/1988 | Tsunoda et al. | |
| 4,750,545 | A | 6/1988 | Hile et al. | |
| 4,775,100 | A | 10/1988 | Gouldey et al. | |
| 4,837,731 | A | 6/1989 | Levine et al. | |
| 4,932,218 | A | 6/1990 | Robbins | |
| 5,031,412 | A | 7/1991 | Efron et al. | |
| 5,272,477 | A | 12/1993 | Tashima et al. | |
| 5,978,738 | A | 11/1999 | Brown | |
| 6,076,044 | A | 6/2000 | Brown | |
| 6,116,512 | A | 9/2000 | Dushane et al. | |
| 6,357,243 | B1 | 3/2002 | Efron et al. | |
| 6,513,723 | B1 | 2/2003 | Mueller et al. | |
| 6,597,990 | B2 | 7/2003 | Brown | |
| 6,619,555 | B2 | 9/2003 | Rosen | |
| 6,622,925 | B2 | 9/2003 | Carner et al. | |
| 6,628,997 | B1 | 9/2003 | Fox et al. | |
| 6,935,570 | B2 | 8/2005 | Acker, Jr. | |
| 8,167,216 | B2 * | 5/2012 | Schultz | F24F 11/006 236/1 B |
| 8,374,725 | B1 * | 2/2013 | Ols | F24F 11/0012 261/118 |
| 8,538,586 | B2 * | 9/2013 | Amundson | F24F 11/0012 165/268 |
| 2005/0077365 | A1 * | 4/2005 | DeLuca | F23N 5/203 236/46 R |
| 2010/0308119 | A1 * | 12/2010 | Steinberg | G05B 19/0426 236/51 |

* cited by examiner

*Primary Examiner* — Emmanuel Duke
(74) *Attorney, Agent, or Firm* — R. Ruschena Patent Agent, LLC

(57) ABSTRACT

A controller system to control and operate a paired evaporative cooler using a wireless remote sensor to detect outside temperature, humidity and barometric pressure transmitted via a radio frequency transceiver to be processed by a programmable main controller unit by a user according to a plurality of programming modes to generate digital control data to be sent to the paired evaporative cooler to control its fan's speed and water pump's speed; the paired evaporative cooler can also be controlled using wireless communication by a hand held remote control device controlling a switching unit mounted inside the paired evaporative cooler; additionally, the main controller unit can receive control data by an incorporated Wi-Fi receiver and transmitter which will allow real time control and programming of the main controller unit from either a personal computer, or a mobile computing device, or a smart cellular phone.

11 Claims, 11 Drawing Sheets

ELECTRONIC EVAPORATIVE COOLER CONTROLLER WITH WIRELESS REMOTE SENSOR

BACKGROUND OF THE INVENTION

1. Field of the Invention

This application relates generally to evaporative coolers and more particularly to an evaporative cooler paired to a programmable controller system which is coupled to a wireless remote sensor unit which collects outside environmental data.

2. Brief Description of the Prior Art

Wireless transmission of data, and specifically environmental data such as temperature and humidity, has seen much in the way of prior art. The main use of this data has been in weather recording and reporting. An example of this prior art is U.S. Pat. No. 6,597,990, which discloses a weather detector and alarm. This use of prior art only reports and displays the transmitted data, whereas this invention also uses the data for process control.

Evaporative coolers, also known as swamp coolers are best suited to dry desert climates like that found in the southwestern United States. Evaporative coolers (FIG. 1) generally comprise a generally cubical metal structure of three to four feet in length, height, and width that is mounted on the exterior or roof of the building to be cooled. Three or four of the sides of the evaporative cooler comprise removable frames that contain pads 102 made of either natural or synthetic materials. The bottom of the evaporative cooler contains water 106 to a depth that is controlled by a float 104 to about four inches. The water is circulated by a water pump 105 through distribution tubes 107 to the tops of the pads to keep them wet. A blower fan 101,103 centrally located within the evaporative cooler pulls dry outside air 108 through the wet pads 102 and exhausts cooled air 110 into a duct distribution system 109 located within the building. Exemplary of such prior art evaporative coolers is that described in U.S. Pat. No. 4,379,712.

There are two significant problems with the prior art of evaporative coolers. The first is their high water usage, and the second is inability to respond to changing environmental conditions, creating a condition of high humidity inside the building being cooled.

Prior art evaporative coolers of the type commercially available are generally controlled by a simple rotary six position switch (FIG. 2) that allows the user to select a combination of water pump and blower fan settings. These manual switches are usually left in one position all day and do not address either of the previously mentioned problems. Manual control switches allow high water usage of approximately 15-20 gallons per hour and are unable to respond when outside conditions, such as rain or sunset, change the cooling requirements of the building.

There have been a number of attempts in the prior art to solve the problem of controlling evaporative cooler through the use of thermostats. Exemplary of the prior art are U.S. Pat. Nos. 4,232,531, 4,580,403, 4,673,028, and 4,4775,100. While providing an improvement over manual control, the use of line voltage thermostats have their own drawbacks. U.S. Pat. No. 4,4775,100 discloses a wide range of plus or minus 20 degrees Fahrenheit to prevent rapid cycling of the evaporative cooler, which allows hot outside air to enter the building. Since simple thermostat control turns on the water pump and blower fan at the same time, this will blow hot outside air into the building until the pads are properly wet. U.S. Pat. No. 5,031,412 has solved some of these problems by incorporating into a digital electronic controller, a thermostat and a real time clock. The clock allows for a cycle of pre-wetting the pads before starting the blower, and for starting and stopping the evaporative cooler at specific times of the day, such as morning or evening when outside temperatures are cooler. It is still unable to adapt to changing environmental conditions and may cause high interior humidity levels leading to personal discomfort, and possibly building damage, if left uncorrected.

SUMMARY OF THE INVENTION

In accordance with the present invention, the above and other problems are solved by the use of a microprocessor based logic system, with temperature and humidity sensors in the evaporative cooler controller, and the addition of an outside sensor that wirelessly reports external temperature, humidity and barometric pressure back to the controller. The addition of the microprocessor and the extra sensors allows better control of the interior temperature and humidity by responding to changing environmental conditions both inside and outside.

For example, a typical problem associated with evaporative coolers is that when left operating unattended and the outside humidity increases, such as during a rain shower, the interior humidity can increase to the point of condensation, causing damage with repeated occurrences. This problem is solved by comparing the interior and exterior temperature and humidity using sensors. The end user is able to adjust the interior and exterior temperature and humidity settings to their comfort level and the microprocessor will compare them to current readings. If the outside humidity level increases above the set level, such as during a rain shower, the water pump will be automatically shut off but rain cooled air will continue to be circulated. If the interior humidity goes above the pre-set level, the water pump will again be shut off and drier air is circulated. Another example is that in the regions where evaporative coolers are most useful, there is usually a large difference in temperature between daytime and nighttime. The night air is much cooler and usually does not need additional cooling. The external temperature sensor measures this value and the controller will again turn off the water pump and continue to circulate the cooler air inside the building.

The addition of a real time clock and adjustable start and stop timers allows for further control such as when the building is unoccupied. The real time clock is augmented with a receiver to use NIST radio transmitted time signals or GPS signals to set the time, with the user only setting the time zone, which would be maintained in the EEprom memory. Usually after a cool night, a building will retain its cooler temperature for a few hours. The start and stop timers allow the cooling system to be shut down until shortly before the building is expected to be occupied, and then automatically start to cool the building to a comfortable temperature.

Another advantage is the microprocessor logic control of the fan speed. If for example the actual temperature is more than five degrees above the user set temperature, the automatic control will enable the fan on the high speed. When for example the difference between the actual temperature and the user set temperature decreases below five degrees the fan will be automatically switched to a lower speed.

Microprocessor control of the pre-wet feature for wetting the cooling pads allows the system to use this feature only when necessary such as when starting the system or restarting the water pump after an automatic shutdown. It is not necessary when switching between fan modes.

The end user has programmable control of the interior and exterior temperature and humidity settings and the start and stop times, including separate start and stop times for weekdays and weekends. Additionally, there are full manual controls that provide access to all the manual settings normally found on the industry standard six position control switch.

In accordance with other aspects, the present invention relates to a system for controlling the output of an evaporative cooler in such a manner as to regulate the interior temperature and humidity of a building, in response to changing environmental conditions inside and outside of the building.

The great utility of the invention is that by limiting operating time of the evaporative cooler to when it is actually needed, there is significant savings in water use and electricity costs, as well as an increase in personal comfort. This is all accomplished without the need for any additional building wiring, than what would be necessary for a evaporative cooler wired with the prior art standard six position switch.

These and various other features as well as advantages, which characterize the present invention, will be apparent from a reading of the following detailed description and a review of the associated drawings.

BRIEF DESCRIPTION OF THE DRAWINGS

The accompanying drawings, which are incorporated in and constitute a part of the specifications, illustrate an embodiment of the invention and, together with the description serve to explain the principles of the invention.

DETAILED DESCRIPTION OF THE PREFERRED EMBODIMENTS

Figure 1:
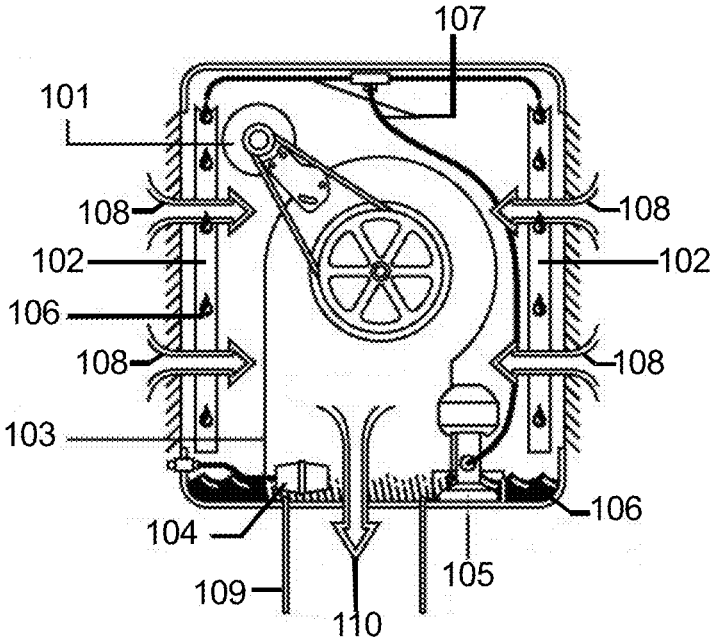
Prior Art Figure 1.
FIG. 1 shows a pictorial diagram of a conventional evaporative cooler.
Figure 2:
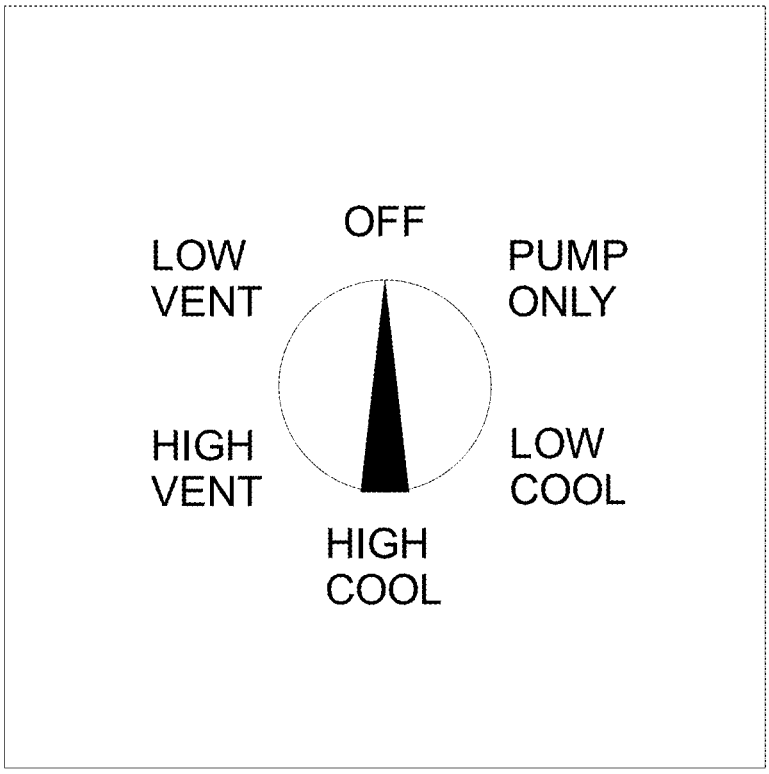
Prior Art Figure 2.
FIG. 2 shows a diagram of a faceplate associated with a typical prior art manually operated control switch employed with evaporative coolers of the type shown in FIG. 1, illustrating the various functions that may be manually selected with such a control switch.

Preferred embodiments of the present invention will be described hereinafter with reference to the accompanying drawings. Referring now to FIG. 1, there is shown a conventional evaporative cooler that includes removable frames on each of three or four side surfaces thereof. Frames hold pads 102 that are typically constructed of shredded aspen wood, paper, or synthetic materials. The bottom of the evaporative cooler comprises a tray that holds fresh water 106 to a level of about four inches, controlled by a float 104. A water pump 105 circulates the water through a number of distribution tubes 107 to the top of each of the pads 102 to keep them wet. A centrally located blower fan 101,103 pulls outside air 108 into the evaporative cooler through the wet pads 102 and exhausts cooled air 110 into a duct distribution system 109 within the building to be cooled. Blower fan 103 is powered by a motor 101, connected thereto by means of a belt and a pulley. A removable overflow tube is employed to drain water from the evaporative cooler to conduct normal maintenance and in the event of failure of float 104. The evaporative cooler of FIG. 1 is typically controlled by a manually operated rotary switch (FIG. 2) employed to select various water pump 105 and blower fan 101,103 functions. These functions are shown on the switch faceplate cover shown in FIG. 2.

Figure 3:
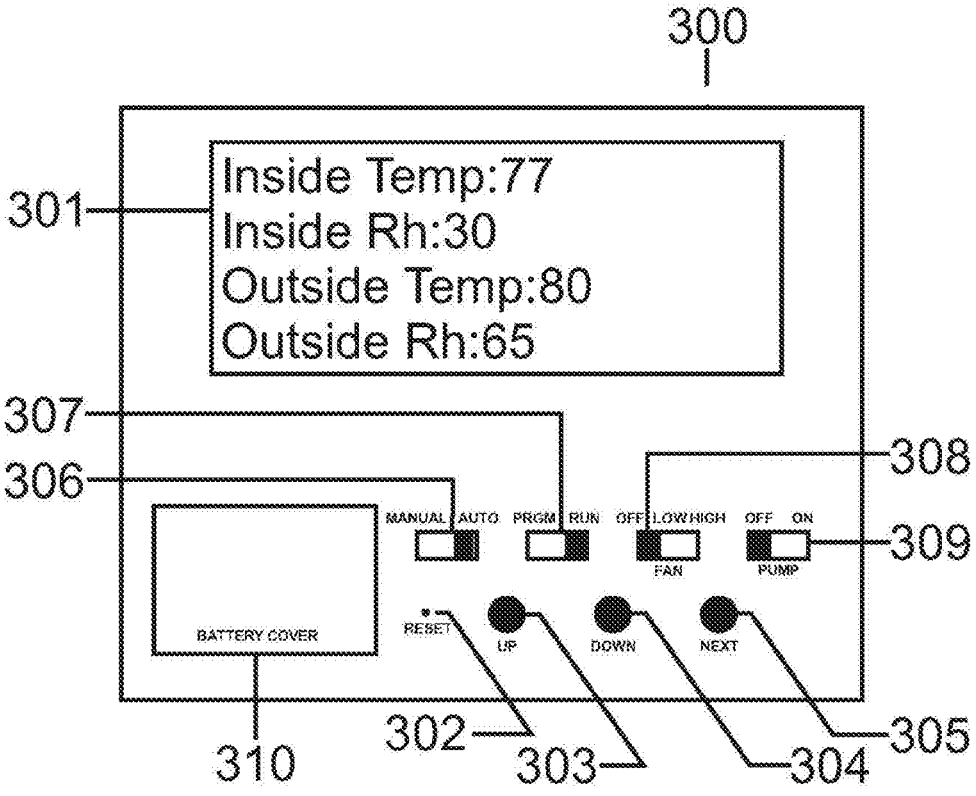
FIG. 3 shows a diagram of the front panel of an evaporative cooler main controller unit, which can be either one electrically and physically connected to the evaporative cooler, or one constructed as a hand held remote control device, operating wirelessly, in accordance with a second embodiment of the present invention.
Figure 4:
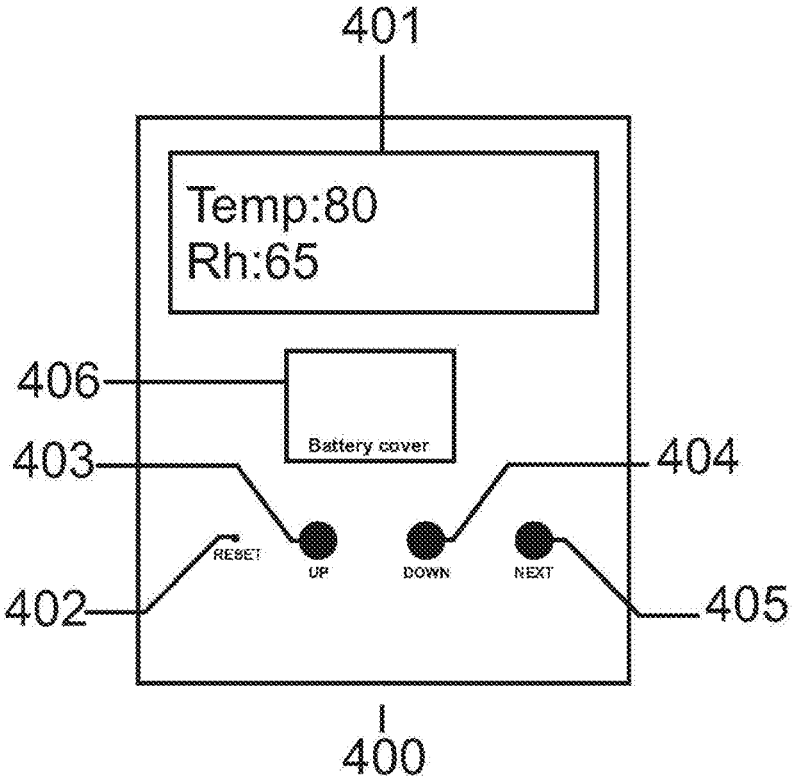
FIG. 4 shows a diagram of the front panel of a wireless remote sensor, used in conjunction with the evaporative cooler controller, and constructed in accordance with the present invention.

The evaporative cooler controller of the present invention includes the main controller, with front panel illustrated in FIG. 3, and a wireless remote sensor, with its front panel illustrated in FIG. 4.

The a main controller unit, is used inside a building, to control the inside temperature and inside humidity by operating and controlling a paired evaporative cooler, said main controller unit is programmable in response to the input data received which are: the outside measured humidity, outside measured temperature and outside barometric pressure, and said main controller unit is programmable according to a plurality of programming modes to generate digital control data to be sent to a paired evaporative cooler to cause the control of variations of the paired evaporative cooler fan's speed and the variations of the paired evaporative cooler water pump speed.

FIG. 3 shows the main controller unit which comprises:

- a radio frequency transceiver to receive wirelessly outside temperature, outside humidity and weather forecast data readings;
- a front panel (FIG. 3) of the main controller unit to allow a user to enter manual controls and input data and to display operating data;
- electrical and electronic interface connections with a paired evaporative cooler device to be controlled and operated;
- a real time clock which allows for timer control of separate weekday and weekend start and stop functioning of a paired evaporative cooler by making a logical comparison with an incorporated timer's time;
- a temperature sensor to collect inside temperature data;
- a humidity sensor to collect inside humidity data;
- a main controller microprocessor programmable by a user;

an Electrically Erasable Programmable Read-Only Memory (EEprom);

a Wi-Fi receiver and transmitter comprising an operating software to allow, through an associated website, real time control and programming of the main controller unit from either a personal computer, or a mobile computing device or a smart cellular phone;

a receiver for radio transmitted time signal from either National Institute of Standards and Technology (NIST) or a Global Positioning System (GPS).

The main controller microprocessor programmable by the user is a eight core parallel microprocessor designed to:

process user control settings including desired indoor and outdoor temperature and humidity;

process of inside temperature, humidity and outside weather forecast, temperature and humidity data from the remote sensor by comparing them to entered user's data to issue operating commands for a paired evaporative cooler;

the control of a paired evaporative cooler fan operation and selection of Its fan's speed;

control of a pre-wet feature to provide pre-wetting of cooling pads of the paired evaporative cooler before starting the controller system or restarting the paired evaporative cooler after an automatic shutdown;

alternates the display of upper limit temperature and upper limit humidity data on the main controller unit LCD display;

loads default settings for the inside temperature and humidity, and the outside temperature and humidity when the microprocessor is powered on;

continually cycle through a series of information and status displays on the LCD display unit; said information displayed comprises current inside and outside temperature and humidity, barometric pressure, barometric pressure history, weather forecast data, complete date and time, desired inside temperature and desired inside humidity settings, weekday and weekend timer status, and timer activity status.

The front panel of the controller 300 in FIG. 3 contains a multi-line backlit liquid crystal display (LCD) 301, four push button switches 302, 303, 304, 305, three, two position slide switches 306, 307, 309, one, three position slide switch 308, and one battery cover 310. The front panel of the wireless remote sensor 400 in FIG. 4 is identified with a unique serial number ID, electronically inserted into all Radio Frequency (RF) communications to allow the remote sensor to electronically communicate data only to a paired main controller unit. The ID number will be input at the controller by the user and saved in the EEprom memory with the other user settings, this enables the user to replace remote sensors if necessary.

The EEprom memory is used to store user settings to avoid their loss in case of a power interruption to the main controller unit. The unique serial number ID is electronically inserted into all Radio Frequency (RF) communications with the remote sensor unit to electronically receive data only from a paired remote sensor unit. The EEprom memory also stores a user-entered time zone offset for National Institute of Standards and Technology (NIST) radio-transmitted time signals or GPS signals.

The front panel of the main controller unit comprises manual switches which are:

Manual/Auto switch 306 which, when set to the Auto position, the main controller microprocessor executes functions based on a logic of an operating program and input data entered by a user; when set to the Manual position, allows a user to manually control the evaporative cooler water pump operation and speed.

Program/Run switch 307 which, when set to a Program position, will cause a programming menu to be displayed and illuminated on a multi-line digital backlit liquid crystal display (LCD) display unit to allow a user to perform a programming sequence; or, when set to a Run position, will cause the programming sequence to terminate;

Off/Low/High Fan switch 308 to manually turn on or off the paired evaporative cooler cooler's fan and to manually adjust its speed;

Off/On Pump switch 309 to manually turn on or off the paired evaporative cooler's water pump;

The front panel of the main controller unit also has manual buttons which are:

Up button 303 to increment the displayed setting by one unit;

Down button 304 to decrement the displayed setting by one unit;

Next button 305 to step through the functions and illuminate the LCD display for five seconds;

Reset button 302 which causes the main controller microprocessor to re-start and clear a possible malfunction.

The battery cover 310 holds a backup battery which, in the event of a main controller unit power loss, will maintain time and date data stored inside a real time clock;

The multi-line digital backlit liquid crystal display (LCD) display unit 301 displays the main controller's programming data. After start up, the microprocessor will continually cycle through a series of information and status displays on the LCD 301. The information displayed consist of current interior and exterior temperature and humidity, current exterior barometric pressure and pressure history, complete date and time, interior temperature and humidity settings, weekday and weekend timer status, and timer activity status.

The front panel allows a user to further program a connected evaporative cooler by entering the following setting data: a desired inside temperature, an upper limit inside humidity, an upper limit outside humidity. Additionally, a unique serial ID number can be entered by a user on the main controller front panel and stored inside a EEprom memory with other user settings, to allow a replacement of a remote sensor, if necessary.

There are two major modes of operation: AUTO and MANUAL. AUTO mode allows the microprocessor full control based on the user selected settings. MANUAL mode requires the user to manually select the fan and water pump settings. While in MANUAL mode the LCD 301 will continue to cycle through the information displays, but the microprocessor will not be able to control the relays that switch the A/C power to the pump and blower fan of the evaporative cooler. This will be controlled by the FAN 308 and PUMP 309 switches. For manual operation, the MANUAL/AUTO switch 306 should be set to MANUAL, the PUMP switch 309 set to ON, and the FAN switch 308 set to either LOW or HIGH.

These settings allow for full control of the evaporative cooler, without a pre-wet function. Manual shutdown for winter or maintenance is accomplished by setting the MANUAL/AUTO switch 306 to MANUAL, the PUMP switch 309 set to OFF, and the FAN switch 308 set to OFF.

With the MANUAL/AUTO switch 306 in the AUTO position, the microprocessor completes functions based on the logic in the operating program and the settings input by the user. The user settings are changed from the default settings by placing the PRGM/RUN 307 switch in the PRGM position, this will cause a programming menu to be displayed and illuminated on the LCD 301. The menu selections are changed by using the UP 303 and DOWN 304 buttons to select the correct numerals, and using the NEXT 305 button to step through the functions. The menu selections are: Inside Temp (Desired inside temperature) Setpoint, Inside Rh (Upper limit inside humidity) Setpoint, Outside Rh (Upper limit outside humidity) Setpoint, Set Date (Current date mm:dd:yy:dow), Set Time (Current time A/P: hh:mm), Set Wkdy (Weekday start of operation) Start (hh:mm), Set Wkdy (weekday) Stop (hh:mm), Weekday Timer On/Off, Set Wknd (weekend) Start (hh:mm), Set Wknd (Set weekend start day and time) Stop (hh:mm), and Weekend Timer On/Off and Set weekend end day and time. At the end of the menu the user receives a prompt to set the PRGM/RUN 307 switch back to the RUN position.

At the end of the programming sequence, the microprocessor automatically saves the chosen Current date and Current Time to the real time clock, the remaining data is saved to a EEprom Memory for storage and to RAM (random access memory) for program working functions. The illumination of the LCD 301 is turned off, and the information and status displays on the LCD 301 resume cycling. Pressing the NEXT 305 button while this data is being displayed will cause the LCD 301 to be illuminated for five seconds. Should it become necessary, momentarily holding down the RESET 302 button will cause the microprocessor to re-start and clear any malfunction. While the microprocessor is being re-started or in the event of a power loss, a back up battery, under the battery cover 310, will maintain the time and date data stored in the real time clock.

FIG. 3 also illustrates the hand held remote control device according to the second embodiment of the invention. The hand held remote control device comprises:

- a radio frequency transceiver to receive wirelessly outside temperature, outside humidity and barometric pressure data readings;
- a front panel to enter manual controls and user input data and to display operating data;
- electrical and electronic interface connections with a wireless-connected switching unit mounted inside an evaporative cooler device to be controlled and operated;
- a real time clock which allows for timer control of separate weekday and weekend start and stop functioning of a paired evaporative cooler;
- a temperature sensor to collect inside temperature data;
- a humidity sensor to collect inside humidity data;
- a main controller microprocessor programmable by a user;
- an Electrically Erasable Programmable Read-Only Memory (EEprom);
- a Wi-Fi receiver and transmitter comprising an operating software to allow, through an associated website, real time control and programming of the main controller unit from either a personal computer, or a mobile computing device or a smart cellular phone;
- a receiver for radio transmitted time signal from either National Institute of Standards and Technology (NIST) or GPS.

The front panel comprises:

- a multi-line digital backlit liquid crystal display (LCD) display unit;
- the manual buttons comprise: Up button to increment the displayed setting by one unit, Down button to decrement the displayed setting by one unit, Next button to step through the functions and illuminate the LCD display for five seconds, a reset button which causes the main controller unit microprocessor to re-start and clear a possible malfunction.

The hand held remote control device allows the user to further program a connected evaporative cooler by entering the following setting data: a desired inside temperature, an upper limit inside humidity, an upper limit outside humidity;

FIG. 4 shows the remote sensor unit 400, operating outside a building, said remote sensor unit is battery-powered, operated by a programmed internal microprocessor to collect outside temperature, outside humidity and outside barometric pressure digital reading data, to be transmitted over a wireless communication medium via a radio frequency transceiver to said main controller unit; said remote sensor unit is radio frequency-coupled to said main controller. The remote sensor unit is operated by a programmed internal microprocessor, and contains a multi-line backlit liquid crystal display (LCD) 401, four push button switches 402, 403, 404, 405, and one battery cover 410.

Figure 6:
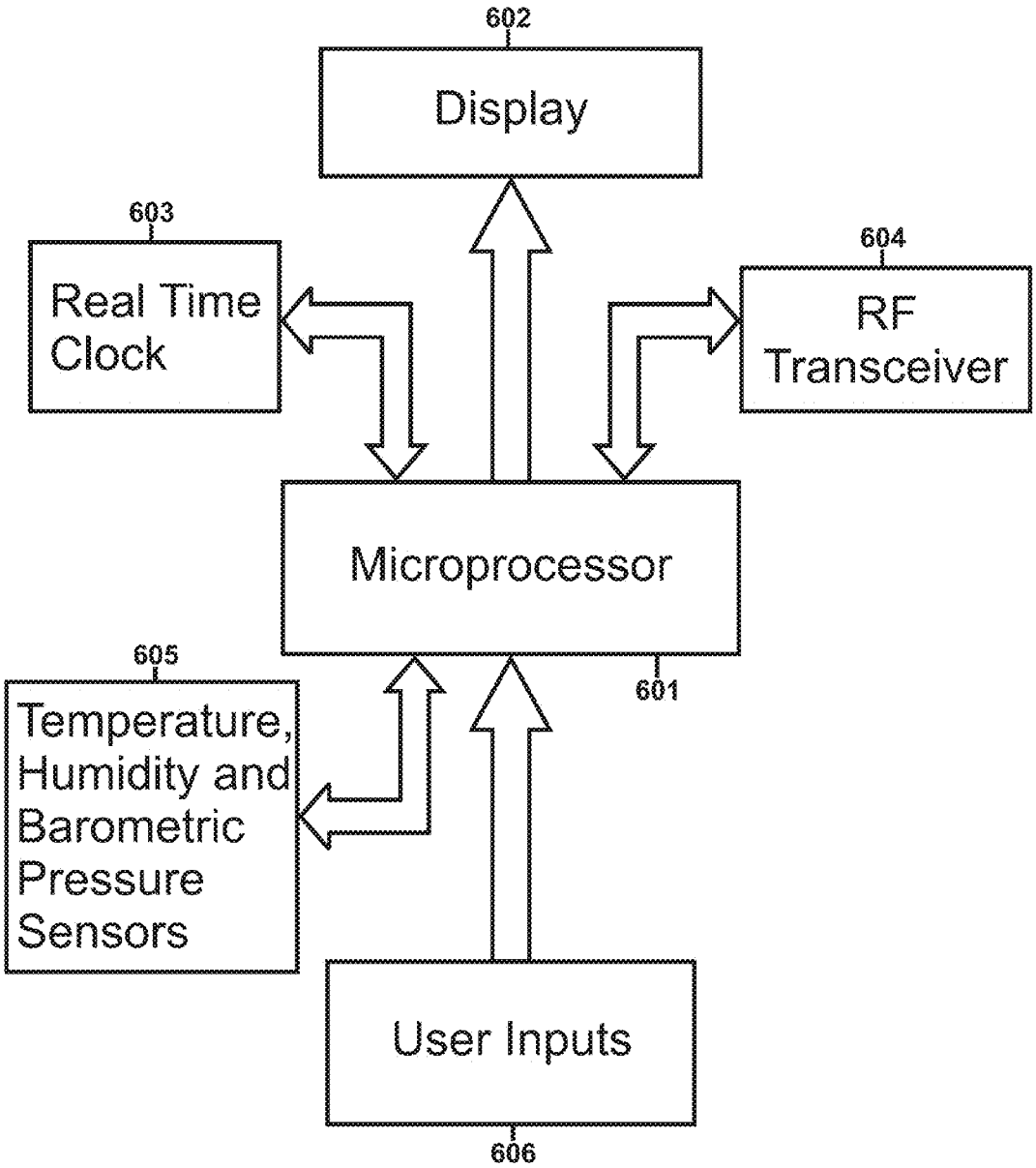
FIG. 6 shows a diagram of the information flow inside the wireless remote sensor.

Referring to FIG. 4 and FIG. 6 describing the information flow of the wireless, outside remote sensor, operation is governed by a microprocessor and associated programmed instructions. When powered on, the microprocessor automatically starts collecting temperature, humidity readings from the temperature and humidity sensors and barometric pressure from a barometric sensor. The barometric pressure will be converted into weather forecast data by a microprocessor software. These readings are then displayed on the LCD 401 and transmitted to the controller via the RF transceiver. The real time clock provides current time data to the microprocessor which it alternates with the temperature, humidity, and barometric pressure data on the LCD 401 display. User settings are accomplished through the manual inputs, (push button switches 402 RESET, 403 UP, 404 DOWN, 405 NEXT.

User settings are saved in the EEprom memory, so that user settings do not have to be re-entered if power to the controller is lost.

Setting of the real time clock is accomplished by holding down the UP button 403 for two seconds to enter the programming mode. Once in the programming mode, the LCD 401 illuminates and displays a menu for setting the month, day, year, and day of the week. These are set using the UP 403 and DOWN 404 buttons to increment or decrement the displayed setting by one unit, and using the NEXT 405 button to step through the functions and illuminate the LCD display for five seconds. After setting the day and date, another menu for setting the time is automatically displayed. Setting of the time is accomplished in the same manner. At the end of the programming sequence, the microprocessor automatically saves the chosen date and time to the real time clock, turns off the illumination of the LCD 401, and resumes alternating the temperature and humidity data with the date and time in the display. Pressing the NEXT button while this data is being displayed will cause the LCD 401 to be illuminated for five seconds. Should it become necessary, momentarily holding down the RESET 402 button will cause the microprocessor to re-start and clear any eventual malfunction. While the microprocessor is being re-started or in the event of a power loss, a back up battery, under the battery cover 406, will maintain the time and date data stored in the real time clock.

The battery cover 406 will hold a backup battery which, in the event of a power loss, will maintain time and date data stored inside a real time clock;

The remote sensor microprocessor, programmable by a user, is an eight-core parallel microprocessor designed to maintain a real time clock, command the outside temperature humidity and barometric pressure sensors to collect outside temperature, outside humidity and weather forecast data to be transmitted wirelessly to the main controller micro-processor for processing.

Figure 5:
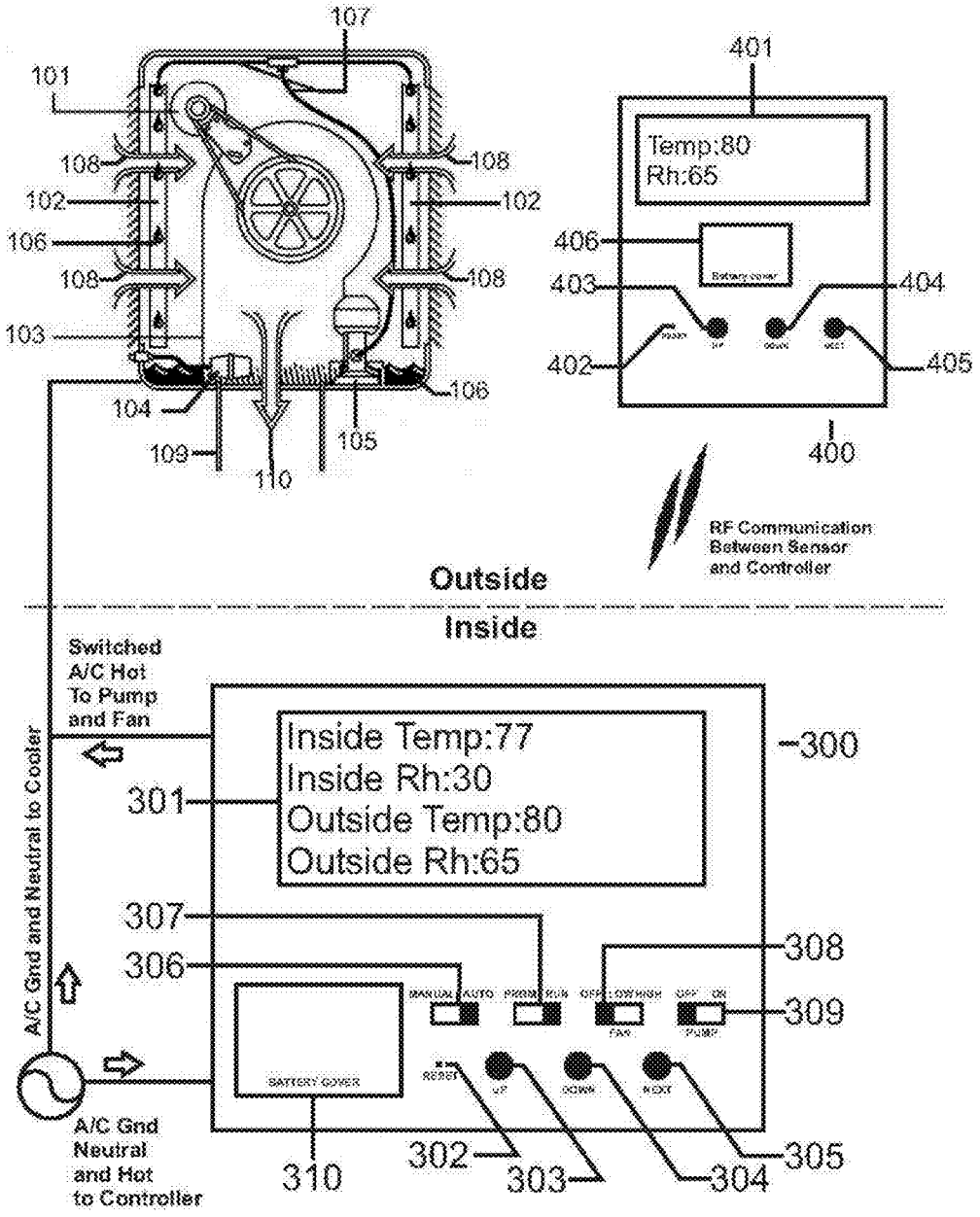
FIG. 5 shows a diagram of the relationship between the wireless remote sensor, the evaporative cooler controller, and the evaporative cooler.

FIG. 5 is a diagram of the relationship between the wireless remote sensor, the main controller, and the evaporative cooler.

FIG. 6 shows a diagram of the information flow inside the wireless remote sensor, where operation is governed by a microprocessor 601 and associated programmed instructions. The microprocessor also automatically starts collecting temperature, humidity and barometric pressure readings from the temperature, humidity and barometric pressure sensors 605. The RF transceiver 604 will transmit the collected data to the. The real time clock 603 will provide current time data to the microprocessor 601 for display and logical comparison for the operation of the timer. The microprocessor will process also user input 606. The microprocessor will continually cycle through a series of information and status displays on the LCD 602.

Figure 7:
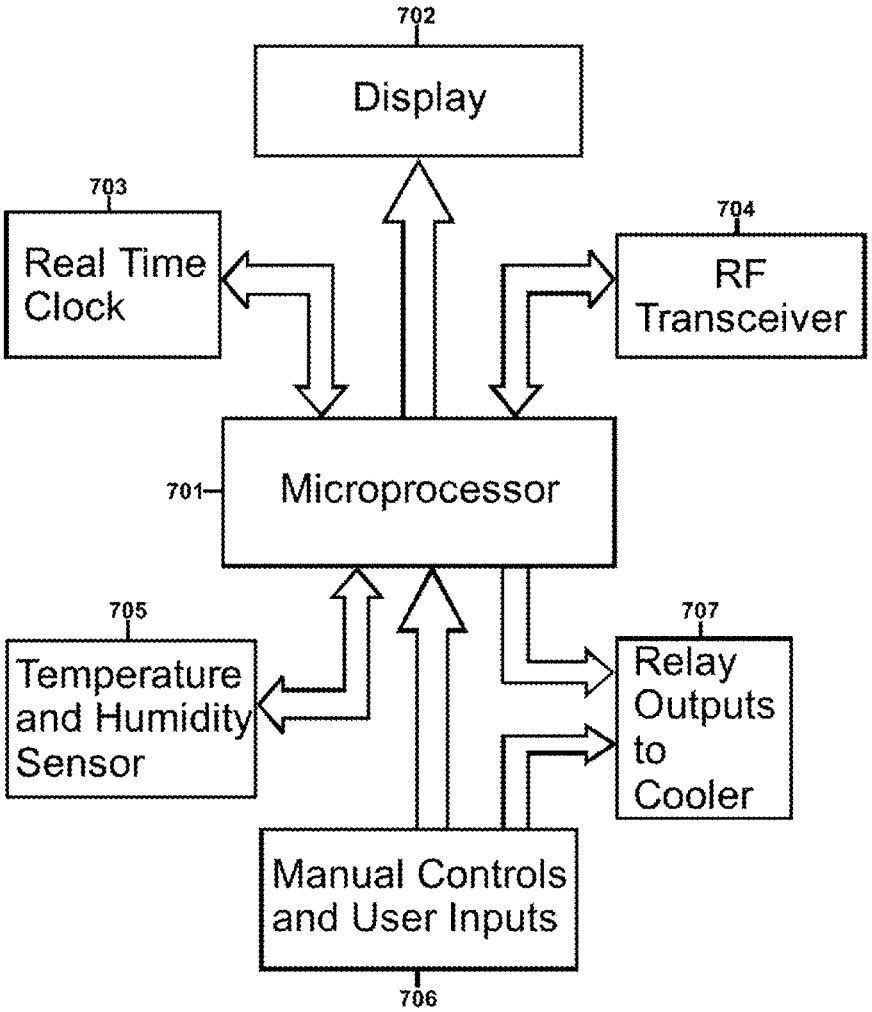
FIG. 7 shows a diagram of the information flow inside the evaporative cooler controller.

Referring to FIG. 7 describing the information flow of the evaporative cooler controller, operation is governed by a microprocessor 701 and associated programmed instructions. When powered on, the microprocessor 701 loads the default settings for the interior temperature and humidity, and the exterior temperature, humidity and barometric pressure. The microprocessor also automatically starts collecting temperature and humidity readings from the local temperature and humidity sensors 705. The RF transceiver 704 will automatically receive the transmission from the remote sensor (FIG. 3), and send that data to the microprocessor 701. The real time clock 703 will provide current time data to the microprocessor 701 for display and logical comparison for the operation of the timer. Depending on the switch settings of the manual controls, and the actual temperature and humidity, the relays that switch the A/C power to the pump and blower fan of the evaporative cooler may, or may not activate upon start up. The microprocessor will continually cycle through a series of information and status displays on the LCD 702. The information displayed consist of current interior and exterior temperature and humidity, outside barometric pressure and pressure history, complete date and time, interior temperature and humidity settings, weekday and weekend timer status, and timer activity status.

Figure 8:
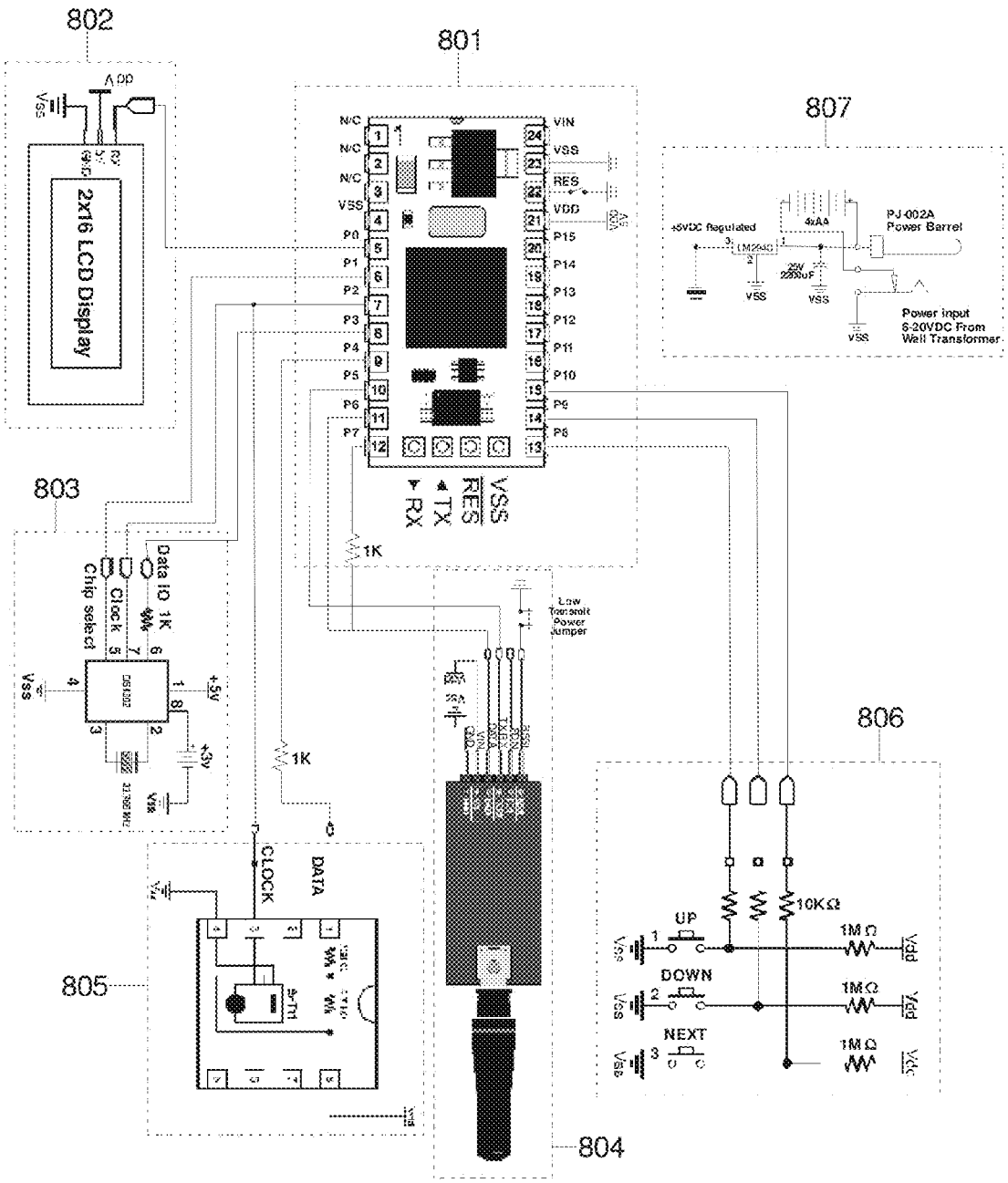
FIG. 8 shows a hardware circuit schematic of the remote sensor.

FIG. 8 is a schematic representation of the remote sensor. The current hardware embodiment consists of an eight core parallel microprocessor 801, a 2×16 digit serial LCD display 802, a real time clock chip with oscillator and backup battery 803, a RF transceiver 804, temperature, humidity, and barometric pressure sensors 805, a 3 button manual input module with current limiting resistors 806, and a power supply and regulation section 807, able to use either batteries or power supplied from a standard 12 Vdc wall transformer. The logic for the microprocessor is written in a derivative of the programming language C, called SPIN, which was written especially for this microprocessor. The program for the remote sensor collects the temperature, humidity, and barometric pressure data, transmits it to the evaporative cooler controller, and maintains the real time clock.

The remote sensor microprocessor, programmable by a user is designed to:

maintain a real time clock;

command the outside temperature humidity and barometric pressure sensors to collect outside temperature, outside humidity and weather forecast data to be transmitted wirelessly to the main controller micro-processor for processing.

Figure 9:
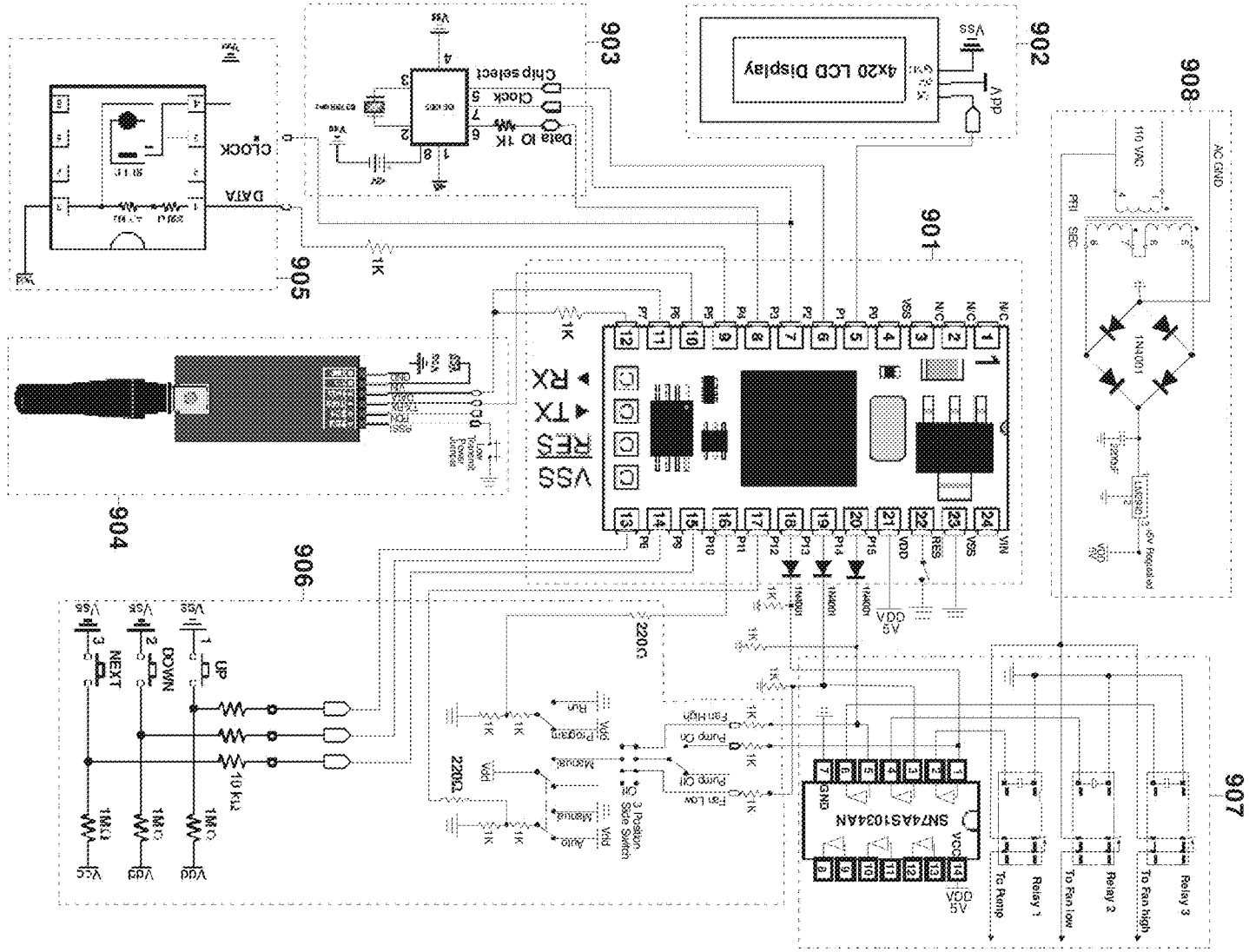
FIG. 9 shows a hardware circuit schematic of the evaporative cooler main controller.

FIG. 9 is a schematic representation of the evaporative cooler main controller, and contains many of the same elements as the remote sensor. The current hardware embodiment consists of an eight core parallel microprocessor 901, a 4×20 digit serial LCD display 902, a real time clock chip with oscillator and backup battery 903, a 433 Mhz RF transceiver 904, a integrated temperature and humidity sensing chip 905, a 3 button manual input module with current limiting resistors and associated switches for full manual or automatic control 906, an output section consisting of AC switching relays and a relay driver 907, and a power supply and regulation section 907, which supplies DC voltage to the logic elements and 120 VAC to the switching relays. Since the microprocessor in the evaporative cooler controller is identical to the one in the remote sensor, the program is written in the same language and incorporates many of the same functions.

Figure 10:
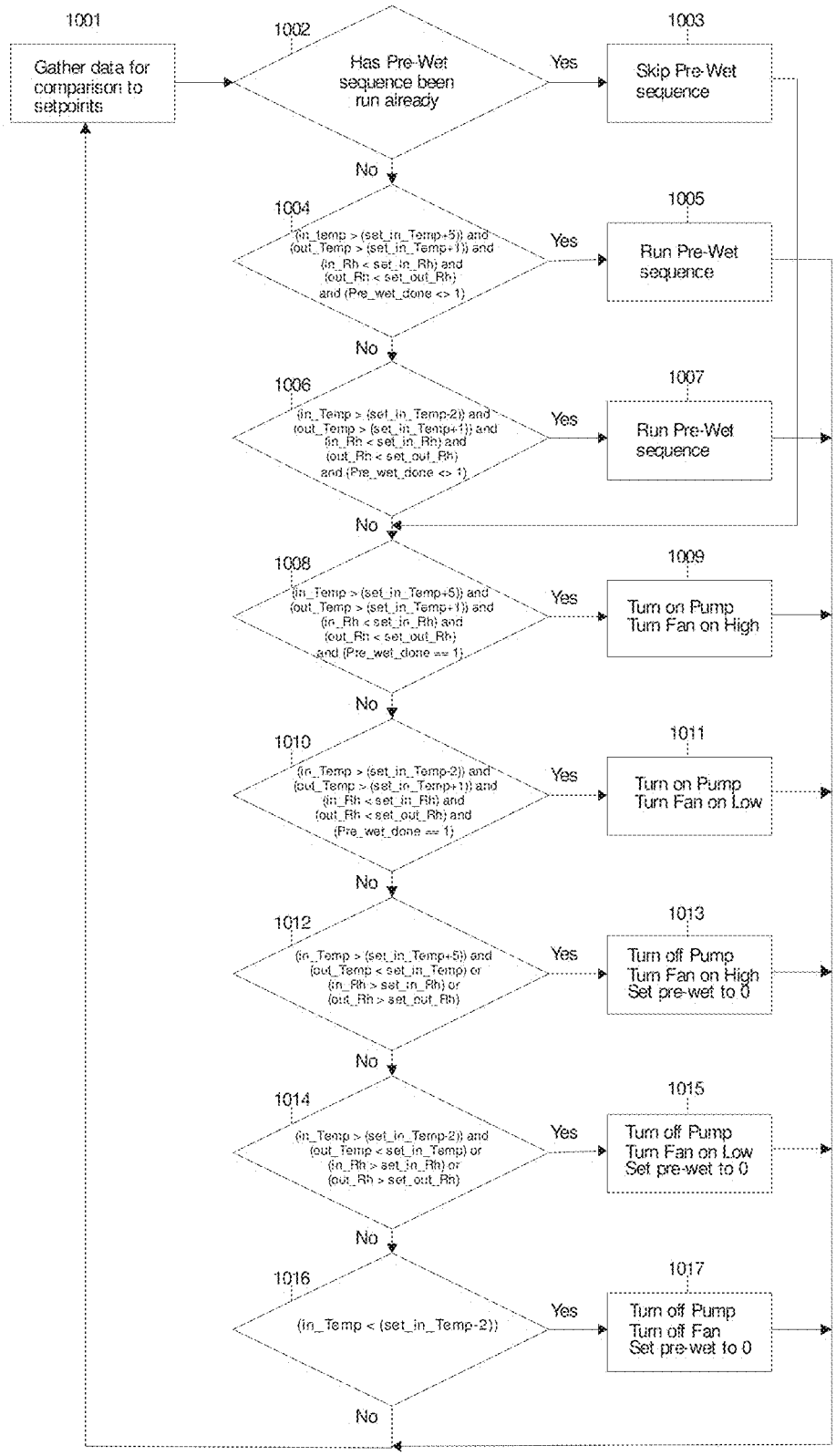
FIG. 10 shows a logic diagram of the section of the evaporative cooler controller program that processes the collected data and switches the relays to the appropriate positions.

FIG. 10 is a logic diagram of the section of the evaporative cooler controller program that processes the collected data and switches the relays to the appropriate positions. The processing of the collected data involves a differential comparison between the user selected set points for temperature and humidity, and the collected data for interior and exterior temperature and humidity. If the interior temperature is more than 5 degrees above the user set point the fan will be set to high speed. If the interior temperature is less than 5 degrees above the user set point the fan will be set to low speed. The fan will run until the interior temperature is 2 degrees less than the user set point to prevent rapid cycling of the fan. If the outside temperature is less than the user set point the pump will be turned off and only the fan will run. If the interior or exterior humidity rises above their respective user set points the pump will be turned off and only the fan will run. The data names on FIG. 10 logic diagram represent:

in_temp is the Current Inside Temperature
out_Temp is the Current Outside Temperature
set_in_Temp is the Desired Inside Temperature
set_in_Rh is the user-set Upper Limit Inside Humidity
set_out_Rh is the user-set Upper Limit Outside Humidity
in_Rh is the Current Inside Humidity
out_Rh is the Current Outside Humidity.

Pre_wet_done is an internal program flag that can be set to zero or one, where zero indicates that the pre-wet sequence will be executed the next time the program logic is executed; the value of one indicates that the pre-wet sequence has been executed and the sequence needs not to be executed the next time the program logic is executed.

Step 1001 covers gathering the data for comparison from the interior sensors in the controller and the exterior sensors in the remote sensor. Step 1002 looks at the flag for the pre-wet sequence, for wetting the pads before the fan is started. If the flag is set, that indicates that the pre-wet sequence, step 1003, has been run and the program can skip steps 1004 through 1007 and go to step 1008. Steps 1004, 1006, 1008, and 1010 are almost identical; all are looking at the data for a combination of factors. They are checking if the inside temperature is greater than the temperature set point, the outside temperature is greater than the temperature set point, the interior humidity is less than the interior humidity set point, the exterior humidity is less than the exterior humidity set point, and whether the pre-wet sequence has been run or not. Steps 1004 and 1008 are checking if the inside temperature is greater than the temperature set point by more than 5 degrees. Steps 1006 and 1010 are checking if the inside temperature is greater than the temperature set point minus 2 degrees. A yes response on either step 1004 or 1006 will cause the pre-wet sequence to be run, steps 1005 and 1007 respectively, which turns on the pump only for 4 minutes, sets the flag to 1, and the program goes around the logic sequence again. With the pre-wet flag set to 1 this allows the rest of the options to come into play.

Step 1008 checks if the inside temperature is greater than the interior temperature set point plus 5 degrees, and the outside temperature is greater than the interior temperature set point plus 1 degree, and the interior humidity is less than the interior humidity set point, and the exterior humidity is less than the exterior humidity set point, and whether the pre-wet sequence has been run or not. A yes decision on step 1008 will turn on the pump and activate the fan on high speed, step 1009.

Step 1010 checks if the inside temperature is greater than the interior temperature set point minus 2 degrees, and the outside temperature is greater than the interior temperature set point plus 1 degree, and the interior humidity is less than the interior humidity set point, and the exterior humidity is less than the exterior humidity set point, and whether the pre-wet sequence has been run or not. A yes decision on step 1010 will turn on the pump and activate the fan on low speed, step 1011.

Step 1012 checks if the inside temperature is greater than the interior temperature set point plus 5 degrees, and the outside temperature is less than the interior temperature set point, or the interior humidity is greater than the interior humidity set point, or the exterior humidity is greater than the exterior humidity set point. A yes decision on step 1012 will turn off the pump, activate the fan on high speed, and set the pre-wet flag to 0, step 1013.

Step 1014 checks if the inside temperature is greater than the interior temperature set point minus 2 degrees, and the outside temperature is less than the interior temperature set point, or the interior humidity is greater than the interior humidity set point, or the exterior humidity is greater than the exterior humidity set point. A yes decision on step 1014 will turn off the pump, activate the fan on low speed, and set the pre-wet flag to 0, step 1015.

Step 1016 checks if the inside temperature is less than the interior temperature set point minus 2 degrees. A yes decision on step 1016 will turn off both the pump and the fan, and set the pre-wet flag to 0, step 1017.

More concisely, the main controller microprocessor executes:

a) a pre-wet sequence whenever:
- a pre-wet internal flag is set to zero and
- the current inside temperature is greater than the desired inside temperature plus five degrees and
- the outside temperature is greater than the desired inside temperature plus one degree and
- the current inside humidity is less than the user-set upper limit inside humidity and
- the current outside humidity is less than the user-set upper limit outside humidity;

or
- a pre-wet internal flag is set to zero and
- the current inside temperature is greater than the desired inside temperature less two degrees and
- the current outside temperature is greater than the desired inside temperature plus one degree and
- the current inside humidity is less than the user-set upper limit inside humidity and
- the outside humidity is less than the user-set upper limit outside humidity;

b) a turning on the cooler's water pump and the turning on high the speed of the cooler's fan whenever:
- a pre-wet internal flag is set to one and
- the current inside temperature is greater than the desired inside temperature plus five degrees and
- the current outside temperature is greater than the desired inside temperature plus one degree and
- the current inside humidity is less than the user-set upper limit inside humidity and
- the current outside humidity is less than the user-set upper limit outside humidity;

c) a turning on the cooler's water pump and the turning on low the speed of the cooler's fan whenever:
- a pre-wet internal flag is set to one and
- the current inside temperature is greater than the desired inside temperature less two degrees and
- the current outside temperature is greater than the desired inside temperature plus one degree and
- the current inside humidity is less than the user-set upper limit inside humidity and
- the current outside humidity is less than the user-set upper limit outside humidity;

d) a turning off the cooler's water pump and the turning on high the speed of the cooler's fan and setting a pre-wet internal flag to zero whenever:
- the current inside temperature is greater than the desired inside temperature plus five degrees and
- the current outside temperature is less than the desired inside temperature or
- the current inside humidity is greater than the user-set upper limit inside humidity or
- the current outside humidity is greater than the user-set upper limit outside humidity;

e) a turning off the cooler's water pump and the turning on low the speed of the cooler's fan and setting a pre-wet internal flag to zero whenever:
- the current inside temperature is greater than the desired inside temperature less two degrees and
- the current outside temperature is less than the desired inside temperature or
- the current inside humidity is greater than the user-set upper limit inside humidity or
- the current outside humidity is greater than the user-set upper limit outside humidity;

f) a turning off the cooler's water pump and the turning off the cooler's fan and setting a pre-wet internal flag to zero whenever the current inside temperature is less than the desired inside temperature less two degrees.

The pre-wet sequence, is commanded and controlled by the main controller unit logic of the microprocessor, and it is executed before the cooler's fan is started for the first time after a time of inactivity, consists in running the cooler's water pump for four minutes to wet the cooling pads which are mounted in front of the cooler's fan inside the controlled evaporative cooler.

Due to the multi-core nature of the chosen microprocessor, this logic tree is continually cycling in parallel with the data collection from the remote sensor and the local sensor on the controller. The data display and real time clock and timer functions are also being maintained in parallel by other processing cores in the microprocessor.

The second embodiment of the invention consists in a main controller divided into two separate units. The primary controller indoor sensors and all control logic resides inside a hand held remote control, coupled to a separate, RF operated, switching unit which is installed inside the cooler to be controlled and operated.

Figure 11:
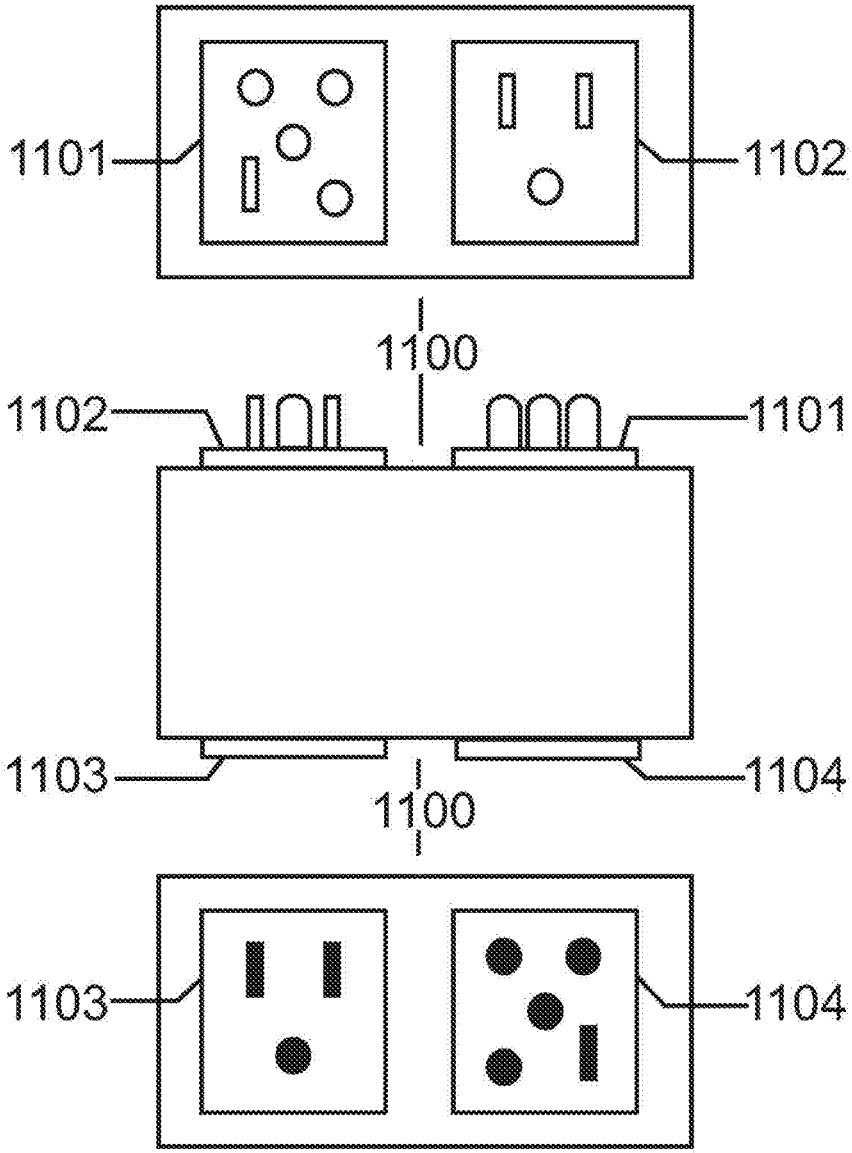
FIG. 11 shows the switching unit, RF operated, and mounted inside an evaporative cooler to be controlled and operated by a hand held remote control device, according to the second embodiment.

FIG. 11 shows the switching unit 1100, RF operated, and mounted inside an evaporative cooler to be controlled, according to the second embodiment.

At the top is the view from the back showing the plugs for the fan 1101 and the pump 1102. These would be inserted into the existing sockets in the evaporative cooler, using the existing plugs for the pump and fan motor and require no extra wiring. At the bottom is the front view showing the replacement sockets for the fan 1104 and the pump 1103. In the center is a top view showing the relative positioning of the sockets and plugs. This unit is situated inside the evaporative cooler between the existing plugs and sockets. Use of this unit would require bypassing any prior art control switch to provide unswitched power to the existing sockets so the unit can control the switching of power for the fan and pump.

The switching unit will comprise a housing equipped with a switching unit comprising a housing, a radio frequency transceiver to receive wirelessly operating commands from said hand held remote control device, a hand-held controller unit microprocessor programmable by a user to process commands from said hand held remote control unit to digitally control the operation and speed of a paired evaporative cooler's water pump and electric fan.

The housing is equipped with an input power plug to be electrically connected to an existing power plug inside an evaporative cooler to be controlled, that currently supplies uncontrolled electric power to the evaporative cooler's electric fan; an input power plug to be electrically connected to an existing power plug, inside an evaporative cooler to be controlled, that currently supplies uncontrolled electric power to the evaporative cooler's electric water pump; an output power plug to be electrically connected to the evaporative cooler's electric fan; an output power plug to be electrically connected to the evaporative cooler's electric water pump;

The logical operations of the various embodiments of the present invention are implemented as a sequence of computer implemented acts or program modules running on a computing system and/or as interconnected machine logic circuits or circuit modules within the computing system. The implementation is a matter of choice dependent on the performance requirements of the computing system implementing the invention. Accordingly, the logical operations making up the embodiments of the present invention described herein are referred to variously as operations, structural devices, acts or modules. It will be recognized by one skilled in the art that these operations, structural devices, acts and modules may be implemented in software, in firmware, in special purpose digital logic, and any combination thereof without deviating from the spirit and scope of the present invention as recited within the claims attached hereto.

Those skilled in the art will readily recognize various modifications and changes that may be made to the present invention without following the example embodiments and applications illustrated and described herein, and without departing from the true spirit and scope of the present invention. The various embodiments described above are provided by way of illustration only and should not be construed to limit the invention which is set forth in the following claims.

The invention claimed is:

1. A wireless, programmable controller system to control and operate a paired evaporative cooler, said controller system comprises:

a main controller unit, used inside a building, to control the building inside temperature and the building inside humidity by operating and controlling a paired evaporative cooler, said main controller unit is programmable in response to input data received which are: outside measured humidity, outside measured temperature and outside barometric pressure, and said main controller unit is programmable according to a plurality of programming modes to generate digital control data to be sent to the paired evaporative cooler to cause a control of variations of a paired evaporative cooler fan's speed and variations of a paired evaporative cooler water pump speed;

a remote sensor unit, operating outside the building, said remote sensor unit is battery-powered, operated by a programmed internal microprocessor to collect outside temperature, outside humidity and outside barometric pressure digital reading data, to be transmitted over a wireless communication medium via a radio frequency transceiver to said main controller unit; said remote sensor unit is radio frequency-coupled to said main controller unit.

2. The wireless, programmable controller system to control and operate the paired evaporative cooler according to claim 1 wherein said main controller unit comprises:

the radio frequency transceiver to receive wirelessly the outside temperature, the outside humidity and weather forecast data readings;

a front panel of said main controller unit to allow a user to enter manual controls and input data and to display operating data;

electrical and electronic interface connections with the paired evaporative cooler device to be controlled and operated;

a real time clock which allows for a timer control of separate weekday and weekend start and stop functioning of the paired evaporative cooler by making a logical comparison with an incorporated timer's time;

a temperature sensor to collect inside temperature data;

a humidity sensor to collect inside humidity data;

a main controller microprocessor programmable by the user;

an Electrically Erasable Programmable Read-Only Memory (EEprom);

a Wi-Fi receiver and transmitter comprising an operating software to allow, through an associated website, real time control and programming of the main controller unit from either a personal computer, or a mobile computing device or a smart cellular phone;

a receiver for radio transmitted time signal from either a National Institute of Standards and Technology (NIST) or a Global Positioning System (GPS).

3. The wireless, programmable controller system to control and operate the paired evaporative cooler according to claim 2 wherein said front panel comprises:

manual switches which are: —a Manual/Auto switch which, when set to:

an Auto position, said main controller unit executes functions based on a logic of an operating program and input data entered by the user;

a Manual position, allows the user to manually control the paired evaporative cooler water pump operation and speed;

a Program/Run switch which, when set to:

a Program position, will cause a programming menu to be displayed and illuminated on a multi-line digital backlit liquid crystal display (LCD) display unit to allow the user to perform a programming sequence;

a Run position, will cause said programming sequence to terminate;

a Off/Low/High Fan switch to manually turn on or off a paired evaporative cooler cooler's fan and to manually adjust the fan speed; —a Off/On Pump switch to manually turn on or off a paired evaporative cooler's water pump;

manual buttons comprising:

Up button to increment a displayed setting by one unit; —Down button to decrement a displayed setting by one unit;

Next button to step through programmed functions and to illuminate a LCD display for five seconds; —Reset button which causes the main controller microprocessor to re-start and clear a possible malfunction;

a battery cover to hold a backup battery which, in an event of a main controller unit power loss, will maintain time and date data stored inside a real time clock;

a multi-line digital backlit liquid crystal display (LCD) unit to display main controller's programming data; and wherein said front panel allows the user to further program a connected evaporative cooler by entering following setting data:

a desired inside temperature; —an upper limit inside humidity;

an upper limit outside humidity;

a current time and day of a week;

a weekday start and stop time;

a weekend start and stop time; and wherein a unique serial ID number can be entered by the user on said front panel and stored inside a EEprom memory with other user settings, to allow a replacement of a remote sensor, if necessary.

4. The wireless, programmable controller system to control and operate the paired evaporative cooler, according to claim 3, wherein said programming menu comprises a display of the following selections:

Desired inside temperature
Upper limit inside humidity
Upper limit outside humidity
Current date—Current time
Weekday start of operation
Weekday stop of operation
Weekday Timer On/Off,
Set weekend start day and time
Set weekend end day and time
Weekend Timer On/Off;

and wherein said Current date and Current Time are saved into a real time clock and the rest of the selections are automatically saved by the microprocessor to an EEprom Memory.

5. The wireless, programmable controller system to control and operate the paired evaporative cooler according to claim 2 wherein said main controller microprocessor programmable by the user is an eight core parallel microprocessor designed to:

process user control settings including desired indoor and outdoor temperature and humidity;

process of inside temperature, humidity and outside weather forecast, temperature and humidity data from the remote sensor unit by comparing them to entered user's data to issue operating commands for the paired evaporative cooler;

control of the paired evaporative cooler fan operation and selection of the fan's speed;

control of a pre-wet feature to provide pre-wetting of cooling pads of the paired evaporative cooler before starting said wireless, programmable controller system or restarting the paired evaporative cooler after an automatic shutdown;

alternate a display of upper limit temperature and upper limit humidity data on said multi-line digital backlit liquid crystal display (LCD) display unit;

load default settings for inside temperature and humidity, and the outside temperature and the humidity when said eight core parallel microprocessor is powered on;

continually cycle through a series of information and status displays on said multi-line digital backlit liquid crystal display (LCD) unit; said information displayed comprises current inside and the outside temperature and outside humidity, barometric pressure, the barometric pressure history, weather forecast data, complete date and time, desired inside temperature and desired inside humidity settings weekday and weekend timer status, and timer activity status.

6. The wireless, programmable controller system to control and operate the paired evaporative cooler according to claim 2 wherein said EEprom memory is used to store user settings to avoid their loss in case of a power interruption to the main controller unit; said EEprom memory also stores a unique serial number ID of the remote sensor unit, said unique serial number ID is electronically inserted into all Radio Frequency (RF) communications with the remote sensor unit to electronically receive data only from a paired remote sensor unit; said EEprom memory also stores the user-entered time zone offset for National Institute of Standards and Technology (NIST) radio-transmitted time signals or GPS signals.

7. The wireless, programmable controller system to control and operate the paired evaporative cooler, according to claim 2 wherein said main controller microprocessor, programmable by the user, executes:

a) a pre-wet sequence whenever:

a pre-wet internal flag is set to zero and current inside temperature is greater than a desired inside temperature plus five degrees and the outside temperature is greater than a desired inside temperature plus one degree and current inside humidity is less than the user-set upper limit inside humidity and current outside humidity is less than the user-set upper limit outside humidity; or a pre-wet internal flag is set to zero and current inside temperature is greater than a desired inside temperature less two degrees and current outside temperature is greater than a desired inside temperature plus one degree and current inside humidity is less than the user-set upper limit inside humidity and the outside humidity is less than the user-set upper limit outside humidity;

b) a turning on a cooler's water pump and turning on high a cooler fan's speed whenever:
a pre-wet internal flag is set to one and
current inside temperature is greater than a desired inside temperature plus five degrees and
current outside temperature is greater than a desired inside temperature plus one degree and
current inside humidity is less than the user-set upper limit inside humidity and
current outside humidity is less than the user-set upper limit outside humidity;

c) a turning on the cooler's water pump and the turning on low a cooler's fan speed whenever:
a pre-wet internal flag is set to one and current inside temperature is greater than a desired inside temperature less two degrees and
current outside temperature is greater than a desired inside temperature plus one degree and
current inside humidity is less than the user-set upper limit inside humidity and
current outside humidity is less than the user-set upper limit outside humidity;

d) a turning off the cooler's water pump and a turning on a cooler's fan high speed and setting a pre-wet internal flag to zero whenever:
current inside temperature is greater than a desired inside temperature plus five degrees and
current outside temperature is less than a desired inside temperature or
current inside humidity is greater than the user-set upper limit inside humidity or
current outside humidity is greater than the user-set upper limit outside humidity;

e) a turning off the cooler's water pump and turning on low a cooler's fan speed and setting a pre-wet internal flag to zero whenever:
current inside temperature is greater than a desired inside temperature less two degrees and
current outside temperature is less than a desired inside temperature or
current inside humidity is greater than the user-set upper limit inside humidity or
current outside humidity is greater than the user-set upper limit outside humidity;

f) a turning off the cooler's water pump and turning off a cooler's fan and setting a pre-wet internal flag to zero whenever a current inside temperature is less than a desired inside temperature less two degrees.

8. The wireless, programmable controller system to control and operate the paired evaporative cooler, according to claim 7 wherein said pre-wet sequence, is commanded and controlled by a main controller unit logic of a microprocessor, and it is executed before a cooler's fan is started for a first time after a time of inactivity, consists in running the cooler's water pump for four minutes to wet cooling pads which are mounted in front of a cooler's fan inside a controlled evaporative cooler.

9. The wireless, programmable controller system to control and operate the paired evaporative cooler according to claim 1 wherein said remote sensor unit identified with a unique serial number ID electronically inserted into all Radio Frequency (RF) communications, allows said remote sensor unit to electronically communicate data only to a paired main controller unit; said remote sensor unit comprises:

a front panel to allow a user to enter programming information and receiving operation information of the remote sensor unit, said front panel comprising:
a multi-line digital backlit liquid crystal display (LCD) unit;
manual buttons which comprise:
an up button to increment a displayed setting by one unit;
a Down button to decrement a displayed setting by one unit;
a Next button to step through all functions and to illuminate said multi-line digital backlit liquid LCD display for five seconds;
a Reset button which causes a remote sensor unit microprocessor to re-start and clear any possible malfunction;
a battery cover to hold a backup battery which, in the event of the remote sensor unit power loss, will maintain time and date data stored inside a real time clock;
a real time clock to provide current time data to the remote sensor unit microprocessor; said real time clock can be set by holding down the UP Button for two seconds to start a programming mode to allow the setting of current day and time;
a temperature sensor to collect the outside temperature data;
a humidity sensor to collect the outside humidity data;
a barometric sensor to detect current the barometric pressure converted into weather forecast data by the remote sensor unit microprocessor;
the radio frequency transceiver to send collected the outside temperature, humidity readings and weather forecast data to the main controller unit via a radio-wave frequency;
a remote sensor unit microprocessor, programmable by the user, which automatically starts collecting from said remote sensor the outside temperature, the outside humidity data and current the barometric pressure readings whenever the remote sensor unit is powered on; said remote sensor unit microprocessor alternates the display of local time, the outside temperature, the outside humidity and the barometric pressure data on the LCD display unit.

10. The wireless, programmable controller system to control and operate the paired evaporative cooler according to claim 9 wherein said remote sensor microprocessor, programmable by the user, is an eight-core parallel microprocessor designed to:
maintain a real time clock;
command the outside temperature humidity and the barometric pressure sensors to collect the outside temperature, the outside humidity and weather forecast data to be transmitted wirelessly to said main controller unit for processing.

11. The wireless, programmable controller system to control and operate the paired evaporative cooler, according to claim 1 wherein said main controller unit comprises:
a hand held remote control device comprising:
the radio frequency transceiver to receive wirelessly the outside temperature, the outside humidity and the barometric pressure data readings;
a front panel to enter manual controls and user input data and to display operating data;
electrical and electronic interface connections with a wireless-connected switching unit mounted inside an evaporative cooler device to be controlled and operated;

a real time clock which allows for timer control of separate weekday and weekend start and stop functioning of the paired evaporative cooler;

a temperature sensor to collect inside temperature data; —a humidity sensor to collect inside humidity data;

a main controller microprocessor programmable by a user;

an Electrically Erasable Programmable Read-Only Memory (EEprom);

a Wi-Fi receiver and transmitter comprising an operating software to allow, through an associated website, real time control and programming of the main controller unit from either a personal computer, or a mobile computing device or a smart cellular phone;

a receiver for radio transmitted time signal from either National Institute of Standards and Technology (NIST) or GPS; and wherein said front panel comprises:

a multi-line digital backlit liquid crystal display (LCD) unit;

manual buttons which comprise:

a up button to increment the displayed setting by one unit;

a down button to decrement the displayed setting by one unit;

a next button to step through the functions and illuminate said digital backlit liquid crystal display (LCD) unit for five seconds;

a reset button which causes a main controller unit microprocessor to re-start and clear a possible malfunction; and wherein said hand held remote control device allows the user to further program a connected evaporative cooler by entering the following setting data:

a desired inside temperature;

an upper limit inside humidity;

an upper limit outside humidity;

a current time and day of a week;

a weekday start and stop time;

a weekend start and stop time;

a switching unit, RF operated, and mounted inside an evaporative cooler to be controlled, said switching unit comprising:

a housing equipped with:

an input power plug to be electrically connected to an existing power plug inside an evaporative cooler to be controlled, that currently supplies uncontrolled electric power to an evaporative cooler's electric fan;

an input power plug to be electrically connected to an existing power plug, inside an evaporative cooler to be controlled, that currently supplies uncontrolled electric power to an evaporative cooler's electric water pump;

an output power plug to be electrically connected to the evaporative cooler's electric fan;

an output power plug to be electrically connected to the evaporative cooler's electric water pump;

the radio frequency transceiver to receive wirelessly operating commands from said hand held remote control device;

a hand-held controller unit microprocessor programmable by the user to process commands from said hand held remote control unit to digitally control operation and speed of a paired evaporative cooler's water pump and an electric fan.

* * * * *